US010894274B1

(12) United States Patent
Al-Shayea et al.

(10) Patent No.: US 10,894,274 B1
(45) Date of Patent: Jan. 19, 2021

(54) FIN AND CONDENSER COIL CLEANING DEVICE FOR AIR CONDITIONER UNITS

(71) Applicant: KING SAUD UNIVERSITY, Riyadh (SA)

(72) Inventors: Adel Mohammed Al-Shayea, Riyadh (SA); Mustufa Haider Abidi, Riyadh (SA); Abdulaziz Mohammed El-Tamimi, Riyadh (SA)

(73) Assignee: KING SAUD UNIVERSITY, Riyadh (SA)

( * ) Notice: Subject to any disclaimer, the term of this patent is extended or adjusted under 35 U.S.C. 154(b) by 0 days.

(21) Appl. No.: 16/925,315

(22) Filed: Jul. 9, 2020

(51) Int. Cl.

| | |
|---|---|
| ***B08B 1/00*** | (2006.01) |
| ***B08B 3/02*** | (2006.01) |
| ***F24F 13/30*** | (2006.01) |
| ***F24F 13/22*** | (2006.01) |
| ***F24F 13/32*** | (2006.01) |

(52) U.S. Cl.
CPC ..... *B08B 1/002* (2013.01); *B08B 3/024* (2013.01); *F24F 13/222* (2013.01); *F24F 13/30* (2013.01); *F24F 13/32* (2013.01); *F24F 2221/22* (2013.01)

(58) Field of Classification Search
CPC ..... B08B 1/002; B08B 3/024; F24F 13/222; F24F 13/30; F24F 13/32; F24F 2221/22
USPC ..... 134/18
See application file for complete search history.

(56) References Cited

U.S. PATENT DOCUMENTS

| | | | |
|---|---|---|---|
| 4,332,292 | A | 6/1982 | Garberick |
| 4,884,416 | A | 12/1989 | Hwang |
| 5,117,644 | A | 6/1992 | Fought |
| 5,279,357 | A | 1/1994 | Kennon et al. |
| 5,461,879 | A | 10/1995 | Bolton et al. |
| 5,682,757 | A | 11/1997 | Peterson |
| 6,318,108 | B1 | 11/2001 | Holstein et al. |
| 8,468,648 | B1 | 6/2013 | Smith et al. |
| 9,593,895 | B2 | 3/2017 | Kim |
| 10,365,053 | B2 | 7/2019 | Billings |
| 2010/0125969 | A1 | 5/2010 | Genna et al. |

*Primary Examiner* — Tinsae B Ayalew
(74) *Attorney, Agent, or Firm* — Nath, Goldberg & Meyer; Richard C. Litman

(57) ABSTRACT

The fin and condenser coil cleaning device for air conditioner units is a cleaning device for cleaning the fins and condenser coils of window-mounted air conditioner units. A horizontal support is driven to selectively raise and lower with respect to the fins on the exterior portion of an air conditioner unit. The horizontal support carries nozzles for spraying water on the fins at sufficient pressure that the water passes through the fins and cleans the condenser coils contained within the housing of the air conditioner unit. A plurality of brushes are mounted on the horizontal support for brushing the fins as the horizontal support moves vertically with respect thereto. Sensors may be provided for controlling the direction of vertical movement of the horizontal support and for selectively actuating a motor and a pump for driving movement of the horizontal support and spraying the water through the nozzles.

20 Claims, 5 Drawing Sheets

FIN AND CONDENSER COIL CLEANING DEVICE FOR AIR CONDITIONER UNITS

BACKGROUND

1. Field

The disclosure of the present patent application relates to air conditioners, and particularly to a fin and condenser cleaning device for air conditioner units to clean the fins and condenser coil of a window-mounted air conditioner.

2. Description of the Related Art

Window-mounted air conditioner units typically have "fins" on their exterior surfaces (i.e., on the surfaces that face outside). The air conditioner fins serve two key purposes: keeping the unit safe from weather, debris and lawn maintenance equipment, such as lawnmowers and grass trimmers; and to help move warm air away from the air conditioner unit to keep the air conditioner running efficiently. Because the fins are mounted outside and are constantly exposed to precipitation and debris, it is very important to keep the fins clean so that the air conditioner unit can run efficiently. The fins are typically very delicate, so harsh methods, such as power washing, can easily bend or dislodge them. A typical gentler cleaning method is to use a "fin comb", which requires manual combing of debris from the fins. This can be a time-consuming and laborious process and typically only removes large-scale solid debris. Fin combs do not remove encrusted dirt or the like, and also do not penetrate any further than the fins, thus neglecting the additional necessary step of cleaning the internal condenser coils of the air conditioner unit. Thus, a fin and condenser coil cleaning device for air conditioner units solving the aforementioned problems is desired.

SUMMARY

The fin and condenser coil cleaning device for air conditioner units is a cleaning device for cleaning the fins and condenser coils of window-mounted air conditioner units. The cleaning device includes first and second vertical supports, each having opposed upper and lower ends. The upper and lower ends of the first and second vertical supports are adapted for mounting adjacent the fins of an air conditioner unit. First and second upper mounting brackets may be used for mounting the upper ends of the first and second vertical supports on the exterior portion of the air conditioner unit adjacent to, and spaced apart from, the fins of the air conditioner unit. Similarly, first and second lower mounting brackets may be provided for mounting the lower ends of the first and second vertical supports adjacent to, and spaced apart from, the fins of the air conditioner unit.

Opposed first and second ends of a horizontal support are slidably mounted on the first and second vertical supports. A vertically extending threaded passage is formed through the horizontal support. A vertically extending threaded rod is partially supported within the vertically extending threaded passage of the horizontal support. A motor is coupled to an upper end of the vertically extending threaded rod for selectively driving rotation thereof. Rotation of the vertically extending threaded rod drives vertical movement of the horizontal support through engagement with the vertically extending threaded passage. A motor bracket may be provided for supporting the motor and the upper end of the vertically extending threaded rod on the exterior portion of the air conditioner unit.

A reservoir is provided for storing water for cleaning the fins and condenser coils of the air conditioner unit. A plurality of nozzles are mounted on the horizontal support, such that a pump can deliver water from the reservoir to the plurality of nozzles for spraying the water at sufficient pressure that it can pass through the fins for cleaning the condenser coils contained within the housing of the air conditioner unit. A plurality of brushes may further be mounted on the horizontal support for brushing the fins as the horizontal support moves vertically with respect thereto.

These and other features of the present subject matter will become readily apparent upon further review of the following specification.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
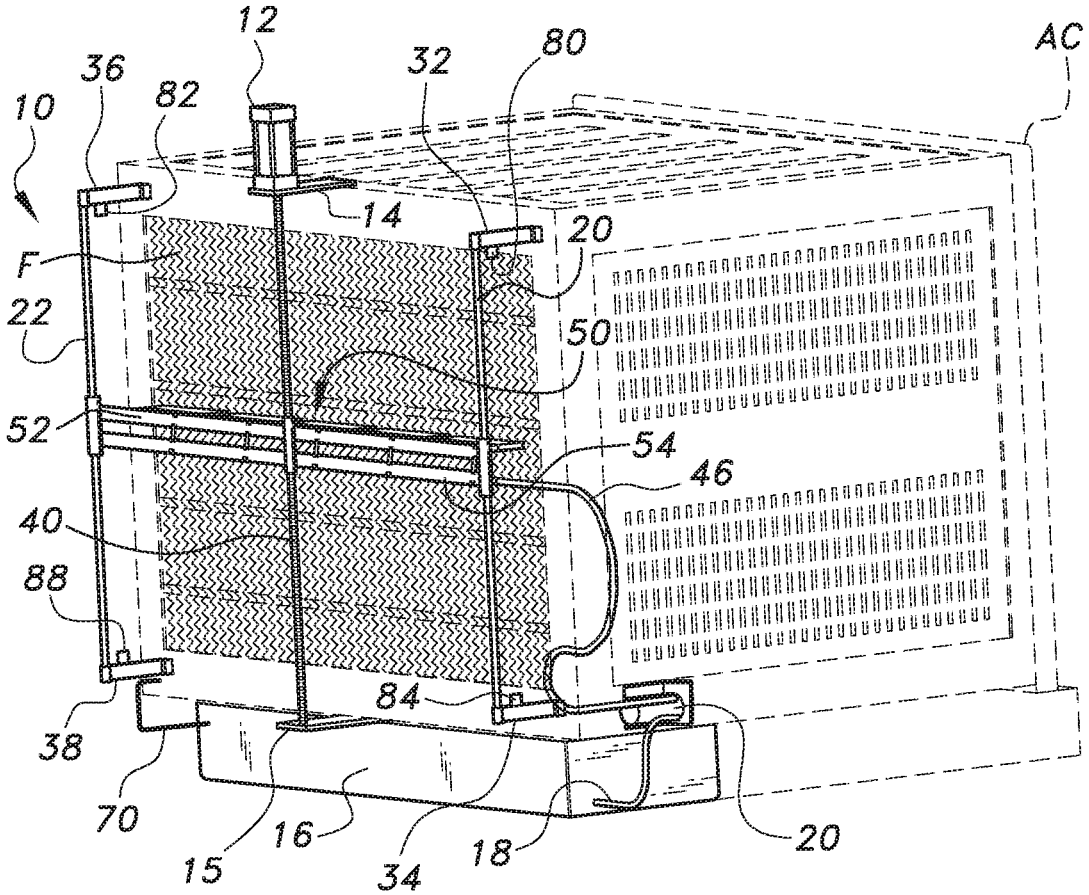
FIG. 1 is an environmental perspective view an air conditioner having a fin and condenser coil cleaning device for air conditioner units mounted on the rear of the air conditioner.
Figure 2:
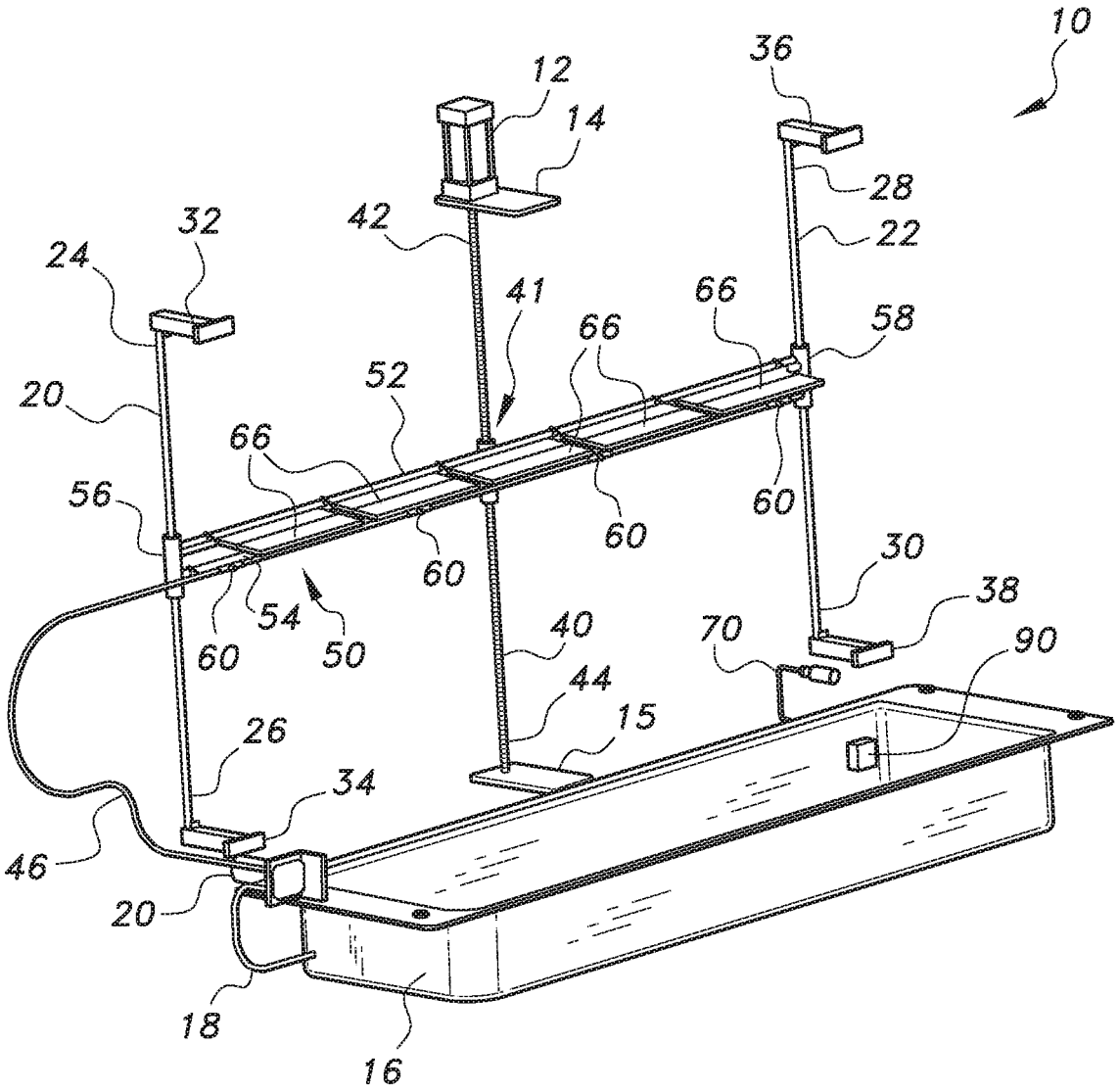
FIG. 2 is a front perspective view of the fin and condenser coil cleaning device of FIG. 1.

The fin and condenser coil cleaning device for air conditioner units, designated generally as 10 in the drawings, is a cleaning device for cleaning the fins and condenser coils of window-mounted air conditioner units. Such units generally have a front portion extending into the building for blowing cool air into the space to be cooled and a rear portion extending out of the building containing a condenser unit for releasing heat to the outside air. The rear portion is exposed to the environment, and may become fouled by exposure to dirt, dust, and airborne contaminants. As shown in FIGS. 1 and 2, the fin and condenser coil cleaning device 10 includes a first vertical support 20 having opposed upper and lower ends 24, 26, respectively. A second vertical support 22 also has opposed upper and lower ends 28, 30, respectively. The first and second vertical supports 20, 22 are adapted for mounting adjacent the fins F of an air conditioner unit AC. It should be understood that window-mounted air conditioner unit AC is shown in FIG. 1 for exemplary purposes only.

First and second upper mounting brackets 32, 36, respectively, may be used for mounting the respective upper ends 24, 28 of the first and second vertical supports 20, 22 on the exterior portion of the air conditioner unit AC adjacent to, and spaced apart from, the fins F. Similarly, first and second lower mounting brackets 34, 38 may be provided for mounting the respective lower ends 26, 30 of the first and second vertical supports 20, 22 adjacent to, and spaced apart from, the fins F.

Opposed first and second ends 56, 58, respectively, of a horizontal support 50 are slidably mounted on the first and second vertical supports 20, 22. It should be understood that the sleeved first and second ends 56, 58 are shown for exemplary purposes only, and that the first and second ends 56, 58 may have any suitable configuration for sliding vertically on the first and second vertical supports 20, 22. It should be further understood that the relative dimensions of the first and second vertical supports 20, 22 and the horizontal support 50 may vary, depending upon the particular size and style of air conditioner unit AC.

A vertically extending threaded passage 41 is formed through the horizontal support 50. A vertically extending threaded rod 40 is supported within and extends through the vertically extending threaded passage 41 of the horizontal support 50. The upper end 42 of the vertically extending threaded rod 40 is attached to a motor 12 for selectively driving rotation of the rod 40. Rotation of the vertically extending threaded rod 40 drives vertical movement of the horizontal support 50 through engagement with the vertically extending threaded passage 41, similar to a screw jack. A motor bracket 14 is provided for supporting the motor 12 on the exterior portion of the air conditioner unit AC.

As shown in FIGS. 1 and 2, first and second upper contact sensors 80, 82 are mounted on the first and second upper mounting brackets 32, 36, respectively, and are in electrical communication with the motor 12. When the first and second upper contact sensors 80, 82 detect contact with the horizontal support 50, the motor 12 reverses direction of rotation of the vertically extending threaded rod 40, thus reversing the direction of vertical movement of the horizontal support 50. Similarly, first and second lower contact sensors 84, 88 are mounted on the first and second lower mounting brackets 34, 38, respectively, and are also in electrical communication with the motor 12. When the first and second lower contact sensors 84, 88 detect contact with the horizontal support 50, the motor 12 reverses direction of rotation of the vertically extending threaded rod 40. It should be understood that contact sensors 80, 82, 84, 88 may be any suitable type of contact sensors, such as pressure switches, mechanical contact switches or the like.

A reservoir 16 is provided for storing water for cleaning the fins F and condenser coils (not shown) of the air conditioner unit AC. The reservoir 16 is disposed below the condenser for catching water that condenses upon contact with the condenser coil, thereby making use of water that would otherwise go to waste. A plurality of sprayer nozzles 60 are mounted on the horizontal support 50, such that a pump 20 can deliver water from the reservoir 16 to the plurality of nozzles 60 for spraying the water at sufficient pressure that it can pass through the fins F for cleaning the condenser coils contained within the housing of the air conditioner unit AC. As shown, a conduit 18 is in fluid communication with the reservoir 16 and the pump 20. Flexible tubing 46 is in fluid communication with the pump 20 and the plurality of nozzles 60. As best seen in FIG. 2, a portion of the flexible tubing 46 is mounted on the horizontal support 50 such that another portion thereof remains free to flex and move as the horizontal support 50 raises and lowers. Flexible tubing 46 may be made from any suitable type of material, such as polyethylene or the like.

Figure 3:
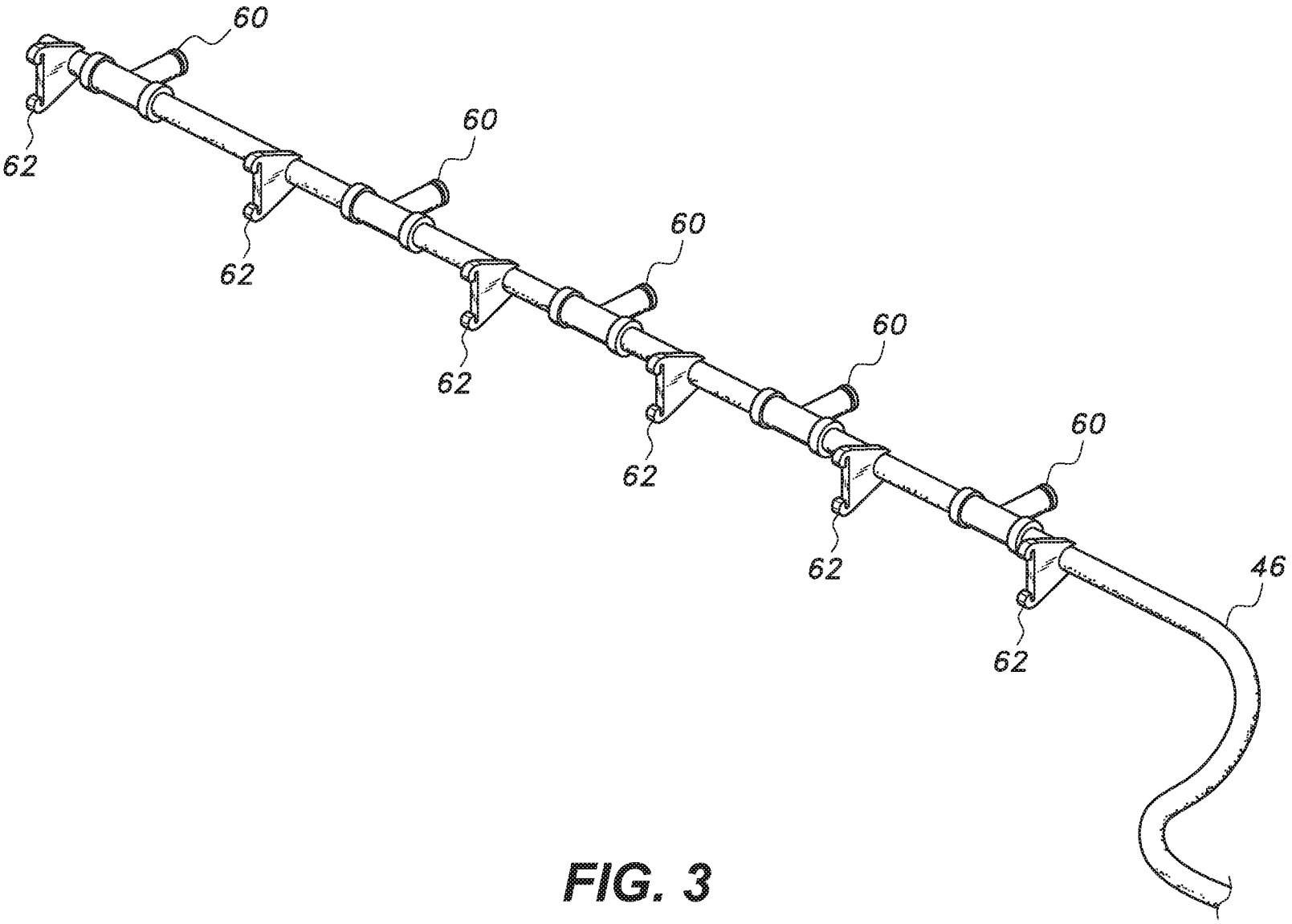
FIG. 3 is a perspective view of an exemplary sprayer system of the fin and condenser coil cleaning device of FIG. 1.
Figure 4:
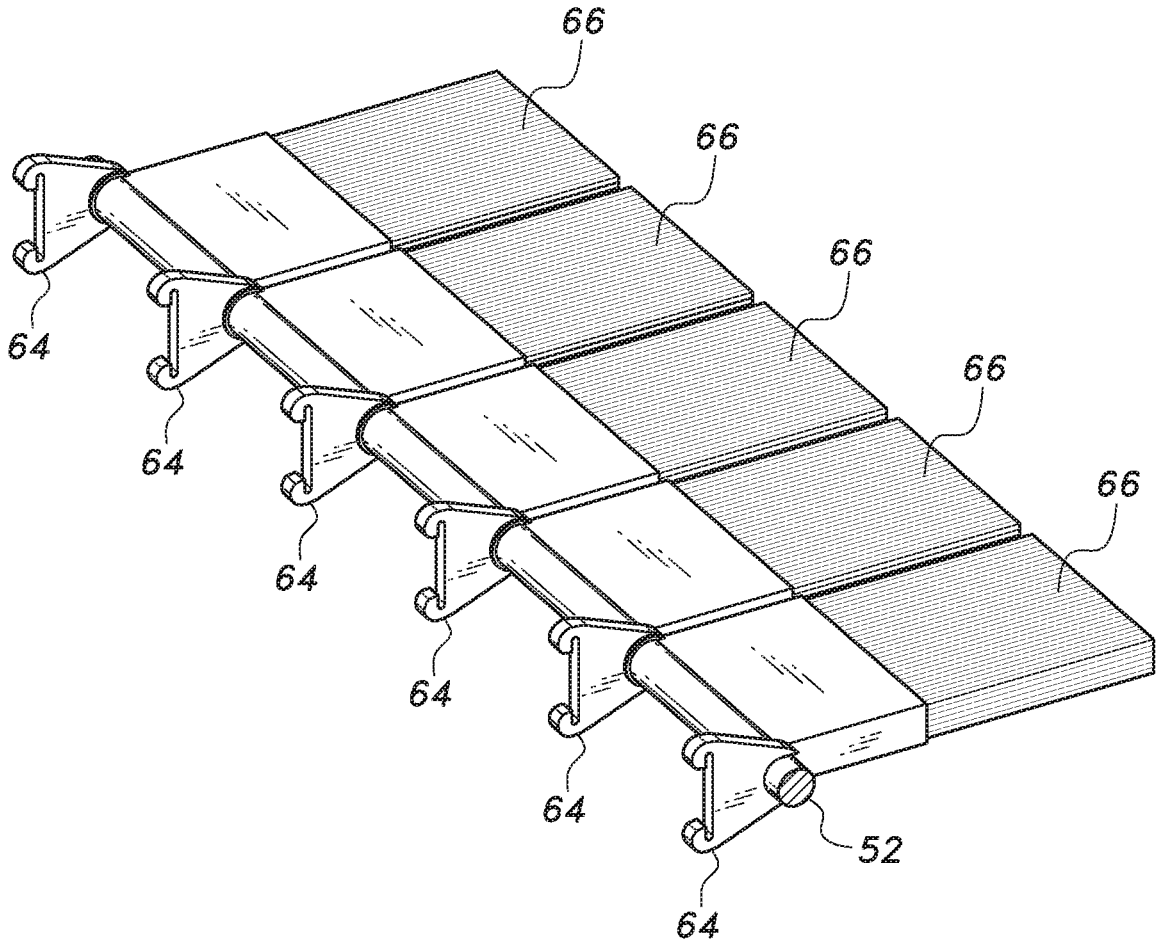
FIG. 4 is a partial perspective view of a brush assembly of the fin and condenser coil cleaning device of FIG. 1.

As best shown in FIG. 2, the horizontal support 50 may include an upper portion 52 and a lower portion 54. The flexible tubing 46 may be secured to the lower portion 54 by any suitable type of attachment. For example, clips 62, as shown in FIG. 3, may be used to attaching the flexible tubing 46 to the lower portion 54. Additionally, a plurality of brushes 66 may be mounted on the horizontal support 50 for brushing the fins F as the horizontal support 50 moves vertically with respect thereto. As shown in FIG. 2, the plurality of brushes 66 may be attached to the upper portion 52 of the horizontal support 50 so that the brushes 66 are mounted above and vertically spaced apart from the nozzles 60. The brushes 66 may be secured to the upper portion 52 by any suitable type of attachment. For example, clips 64, as shown in FIG. 4, may be used for attaching the brushes 66 to the upper portion 52.

Figure 5:
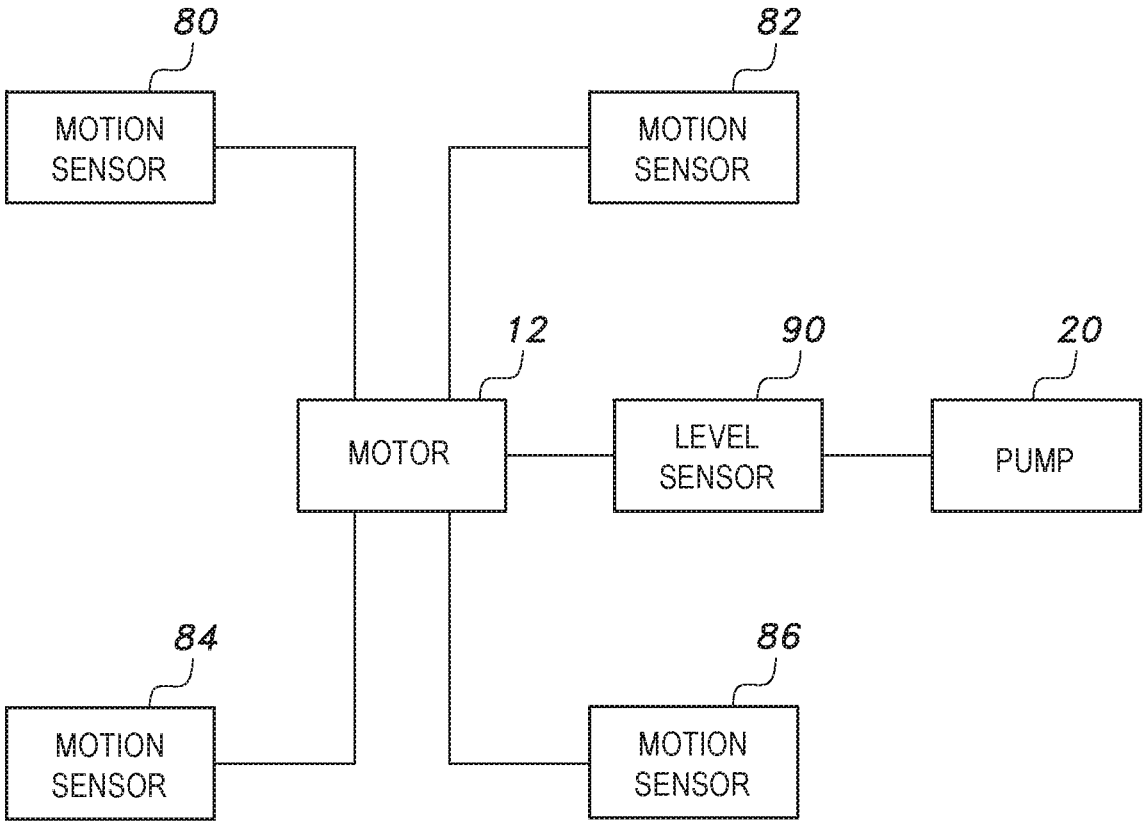
FIG. 5 is a simplified block diagram of control components of the fin and condenser coil cleaning device of FIG. 1.

As shown in FIG. 2, a level sensor 90 may be disposed within the reservoir 16. As illustrated in FIG. 5, the level sensor 90 is in electrical communication with the pump 20 and the motor 12. The pump 20 and the motor 12 are actuated when the level sensor 90 detects a water level in the reservoir 16 at or above a preset threshold. It should be understood that the level sensor 90 may be any suitable type of level sensor, such as a float sensor or the like. It will be understood that FIG. 5 is a simplified block diagram, and the various sensors may send input signals to a microcontroller or similar processor programmed to send an output signal to a motor control circuit connected to the motor 12 and pump 20.

Returning to FIG. 2, a drain pipe 70 may also be in fluid communication with the reservoir 16 for draining condensate from condenser coils of the air conditioner unit into the reservoir 16 to provide the water for cleaning. Additionally, since the water sprayed by the nozzles 60 into the housing of the air conditioner unit will typically be dirty, it is not desirable to have this sprayed water also drained by drain pipe 70. Thus, a one-way valve may be included to close the drain pipe 70 during the cleaning process and for an additional pre-set amount of time thereafter. Additionally, a reservoir bracket 15 may be mounted on the reservoir 16 for rotatably supporting the lower end 44 of the vertically extending threaded rod 40.

In operation, in order to fully use the water contained within the reservoir 16, the spraying process can operate for a time t given by $t=V/f$, where V is the volume of water contained within the reservoir 16 (at the threshold level when cleaning begins) and f is the flow rate from the nozzles 60. The vertical speed of the horizontal support 50, s, is correspondingly given by $s=H/t$, where H is the vertical height of the first and second vertical supports 20, 22, i.e., the vertical height traversed by the horizontal support 50.

It is to be understood that the fin and condenser coil cleaning device for air conditioner units is not limited to the specific embodiments described above, but encompasses any and all embodiments within the scope of the generic language of the following claims enabled by the embodiments described herein, or otherwise shown in the drawings or described above in terms sufficient to enable one of ordinary skill in the art to make and use the claimed subject matter.

We claim:

1. A fin and condenser coil cleaning device for air conditioner units, comprising:

first and second vertical supports, each of the supports having opposed upper and lower ends adapted for mounting adjacent and spaced apart from fins of an air conditioner unit;

a horizontal support having opposed first and second ends slidably mounted on the first and second vertical supports, the horizontal support having a vertically extending threaded passage defined therein;

a vertically extending threaded rod extending through and threadably engaging the vertically extending threaded passage of the horizontal support, the vertically extending threaded rod having opposed upper and lower ends;

a motor, the upper end of the vertically extending threaded rod being attached to the motor for selectively driving rotation of the rod, rotation of the vertically extending threaded rod driving vertical movement of the horizontal support;

a reservoir for storing water;

a plurality of sprayer nozzles mounted on the horizontal support; and a pump and a conduit system connected between the pump, nozzles, and reservoir for delivering the water from the reservoir to the plurality of nozzles.

2. The fin and condenser coil cleaning device as recited in claim 1, further comprising:

first and second upper mounting brackets adapted for attachment to the air conditioner unit, the upper ends of the first and second vertical supports being mounted on the first and second upper mounting brackets, respectively; and first and second lower mounting brackets adapted for attachment to the air conditioner unit, the lower ends of the first and second vertical supports being mounted on the first and second lower mounting brackets, respectively.

3. The fin and condenser coil cleaning device as recited in claim 2, further comprising:

first and second upper contact sensors mounted on the first and second upper mounting brackets, respectively, the upper contact sensors being in electrical communication with the motor, the first and second upper contact sensors being configured to detect contact with the horizontal support, the motor being configured to reverse direction of rotation of the vertically extending threaded rod upon detection of contact with the horizontal support by the upper contact sensors; and first and second lower contact sensors mounted on the first and second lower mounting brackets, the lower contact sensors being in electrical communication with the motor, the first and second lower contact sensors being configured to detect contact with the horizontal support, the motor being configured to reverse direction of rotation of the vertically extending threaded rod upon detection of contact with the horizontal support by the lower contact sensors.

4. The fin and condenser coil cleaning device as recited in claim 1, further comprising flexible tubing in fluid communication with the pump and the plurality of nozzles.

5. The fin and condenser coil cleaning device as recited in claim 4, wherein a portion of the flexible tubing is mounted on the horizontal support.

6. The fin and condenser coil cleaning device as recited in claim 5, wherein the horizontal support comprises an upper portion and a lower portion, the flexible tubing being attached to the lower portion of the horizontal support.

7. The fin and condenser coil cleaning device as recited in claim 6, further comprising a plurality of brushes mounted on the upper portion of the horizontal support, the brushes being configured to clean the fins.

8. The fin and condenser coil cleaning device as recited in claim 1, further comprising a level sensor disposed within the reservoir, the level sensor being in electrical communication with the pump and the motor, so that the pump and the motor are actuated when the level sensor detects a water level in the reservoir at or above a preset threshold.

9. The fin and condenser coil cleaning device as recited in claim 1, further comprising a drain pipe in fluid communication with the reservoir, the drain pipe being adapted for draining condensate from condenser coils of the air conditioner unit into the reservoir.

10. The fin and condenser coil cleaning device as recited in claim 1, further comprising a reservoir bracket mounted on the reservoir for rotatably supporting the lower end of the vertically extending threaded rod.

11. A fin and condenser coil cleaning device for air conditioner units, comprising:

first and second vertical supports, each of the supports having opposed upper and lower ends adapted for mounting adjacent and spaced apart from fins of an air conditioner unit;

a horizontal support having opposed first and second ends slidably mounted on the first and second vertical supports, the horizontal support having a vertically extending threaded passage defined therein;

a vertically extending threaded rod extending through and threadably engaging the vertically extending threaded passage of the horizontal support, the vertically extending threaded rod having opposed upper and lower ends;

a motor, the upper end of the vertically extending threaded rod being attached to the motor for selectively driving rotation of the rod, rotation of the vertically extending threaded rod driving vertical movement of the horizontal support;

a reservoir for storing water;

a plurality of sprayer nozzles mounted on the horizontal support;

a plurality of brushes mounted on the horizontal support; and a pump and a conduit system connected between the pump, nozzles, and reservoir for delivering the water from the reservoir to the plurality of nozzles for delivering the water from the reservoir to the plurality of nozzles.

12. The fin and condenser coil cleaning device as recited in claim 11, further comprising:

first and second upper mounting brackets adapted for attachment to the air conditioner unit, the upper ends of the first and second vertical supports being mounted on the first and second upper mounting brackets, respectively; and first and second lower mounting brackets adapted for attachment to the air conditioner unit, the lower ends of the first and second vertical supports being mounted on the first and second lower mounting brackets, respectively.

13. The fin and condenser coil cleaning device as recited in claim 12, further comprising:

first and second upper contact sensors mounted on the first and second upper mounting brackets, respectively, the upper contact sensors being in electrical communication with the motor, the first and second upper contact sensors being configured to detect contact with the horizontal support, the motor being configured to reverse direction of rotation of the vertically extending threaded rod upon detection of contact with the horizontal support by the upper contact sensors; and first and second lower contact sensors mounted on the first and second lower mounting brackets, the lower contact sensors being in electrical communication with the motor, the first and second lower contact sensors being configured to detect contact with the horizontal support, the motor being configured to reverse direction of rotation of the vertically extending threaded rod upon detection of contact with the horizontal support by the lower contact sensors.

14. The fin and condenser coil cleaning device as recited in claim 11, further comprising flexible tubing in fluid communication with the pump and the plurality of nozzles.

15. The fin and condenser coil cleaning device as recited in claim 14, wherein a portion of the flexible tubing is mounted on the horizontal support.

16. The fin and condenser coil cleaning device as recited in claim 15, wherein the horizontal support comprises an upper portion and a lower portion, the flexible tubing being attached to the lower portion of the horizontal support.

17. The fin and condenser coil cleaning device as recited in claim 16, wherein the plurality of brushes are secured to the upper portion of the horizontal support.

18. The fin and condenser coil cleaning device as recited in claim 11, further comprising a level sensor disposed within the reservoir, the level sensor being in electrical communication with the pump and the motor, so that the pump and the motor are actuated when the level sensor detects a water level in the reservoir at or above a preset threshold.

19. The fin and condenser coil cleaning device as recited in claim 11, further comprising a drain pipe in fluid communication with the reservoir, the drain pipe being adapted for draining condensate from condenser coils of the air conditioner unit into the reservoir.

20. The fin and condenser coil cleaning device as recited in claim 11, further comprising a reservoir bracket mounted on the reservoir for rotatably supporting the lower end of the vertically extending threaded rod.

* * * * *